US009614283B2

(12) United States Patent
Lin et al.

(10) Patent No.: US 9,614,283 B2
(45) Date of Patent: Apr. 4, 2017

(54) ANTENNA STRUCTURE AND WIRELESS COMMUNICATION DEVICE EMPLOYING SAME

(71) Applicant: FIH (Hong Kong) Limited, Kowloon (HK)

(72) Inventors: Shih-Chieh Lin, Shindian (TW); Hao-Ying Chang, Shindian (TW); Cheng-Hung Ko, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 424 days.

(21) Appl. No.: 14/193,204

(22) Filed: Feb. 28, 2014

(65) Prior Publication Data

US 2015/0022415 A1 Jan. 22, 2015

(30) Foreign Application Priority Data

Jul. 17, 2013 (TW) ..... 102125486 A

(51) Int. Cl.

| | |
|---|---|
| ***H01Q 1/52*** | (2006.01) |
| ***H01Q 5/371*** | (2015.01) |
| ***H01Q 1/24*** | (2006.01) |
| ***H01Q 9/42*** | (2006.01) |

(52) U.S. Cl.

CPC ..... *H01Q 5/371* (2015.01); *H01Q 1/243* (2013.01); *H01Q 9/42* (2013.01)

(58) Field of Classification Search

CPC ..... H01Q 5/371; H01Q 9/42

See application file for complete search history.

(56) References Cited

U.S. PATENT DOCUMENTS

| | | | | |
|---|---|---|---|---|
| 6,259,407 B1 * | 7/2001 | Tran | ..... | H01Q 9/42 343/700 MS |
| 2012/0162017 A1 * | 6/2012 | Lee | ..... | H01Q 5/371 343/700 MS |

* cited by examiner

*Primary Examiner* — Hoang V Nguyen
*Assistant Examiner* — Michael Bouizza
(74) *Attorney, Agent, or Firm* — Steven M. Reiss

(57) ABSTRACT

An antenna structure includes a main portion, a first radiating portion connected to the main portion, a second radiating portion connected to the main portion and opposite to the first radiating portion, and a coupling portion spaced from and coplanar with the main portion and opposite to the second radiating portion. The main portion and the first radiating portion excite a low frequency mode, the main portion, the first radiating portion, the second radiating portion, and the coupling portion excite a high frequency mode, and when the antenna structure is interfered by a user's human body when close to the user's human body, the coupling portion transmits the interference to ground. A wireless communication device employing the antenna structure is also disclosed.

18 Claims, 9 Drawing Sheets

ANTENNA STRUCTURE AND WIRELESS COMMUNICATION DEVICE EMPLOYING SAME

BACKGROUND

1. Technical Field

The present disclosure relates to an antenna structure, and especially relates to an antenna structure reducing interference from user's human body and a wireless communication device employing the antenna structure.

2. Description of Related Art

An antenna is used for transceiving wireless signals for a wireless communication device, such as a mobile phone or a personal digital assistant. When the wireless communication device is being operated manually, such as sending SMS, talking via the phone, or surfing the internet, the antenna performance may be interfered by the manual operator, such as reducing an intensity of receiving signals. Some wireless communication device will add an antenna gain structure with large size to improve receiving signals ability. However, the added antenna structure costs more and needs larger space for mounting. Thus, there are still improvements needed in the art for limiting the antenna size and reducing interference from the use's human body.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
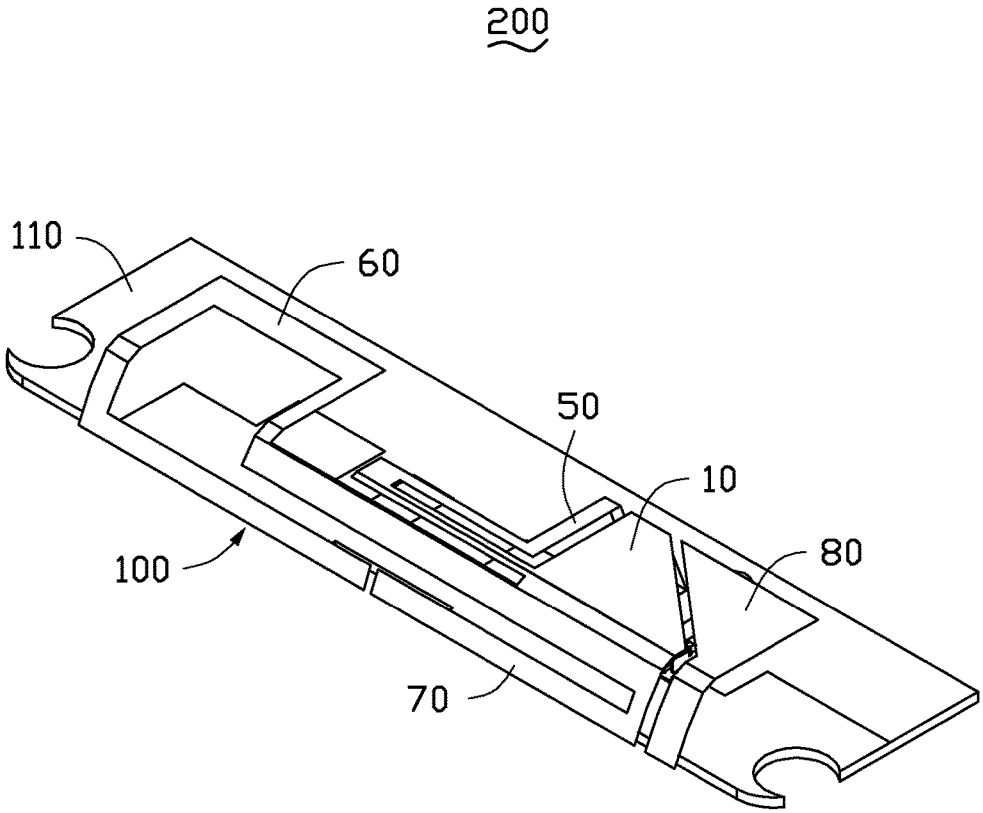
FIG. 1 is a first isometric view of an exemplary embodiment of a wireless communication device having an antenna.

FIG. 1 shows a portion of a wireless communication device 200 having an antenna structure 100 and a circuit board 110, according to an exemplary embodiment. The wireless communication device 200 can be a mobile phone or a tablet computer, for example. The antenna structure 100 is mounted on a carrier (not shown) and is electrically connected to the circuit board 110. The carrier can be a housing of the wireless communication device 200.

Figure 2:
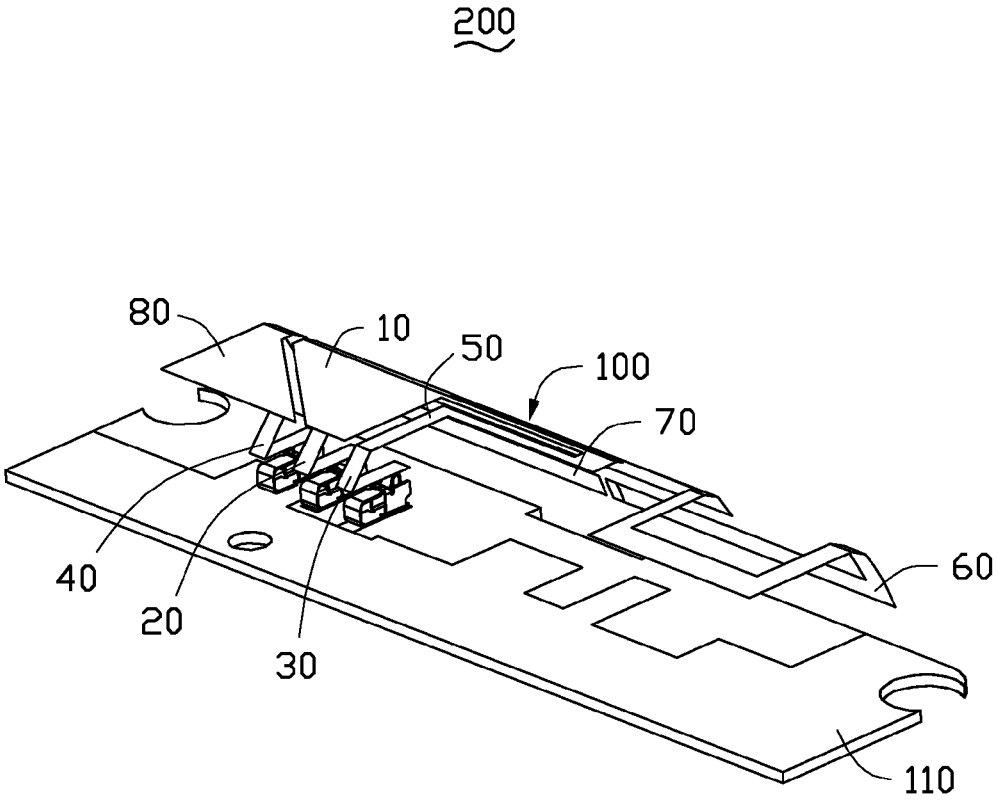
FIG. 2 is a second isometric view of the wireless communication device of FIG. 1.

FIGS. 1 and 2 show that the antenna structure 100 includes a main portion 10, a feed portion 20, a first ground portion 30, a second ground portion 40, a connecting portion 50, a first radiating portion 60, a second radiating portion 70, and a coupling portion 80.

Figure 4:
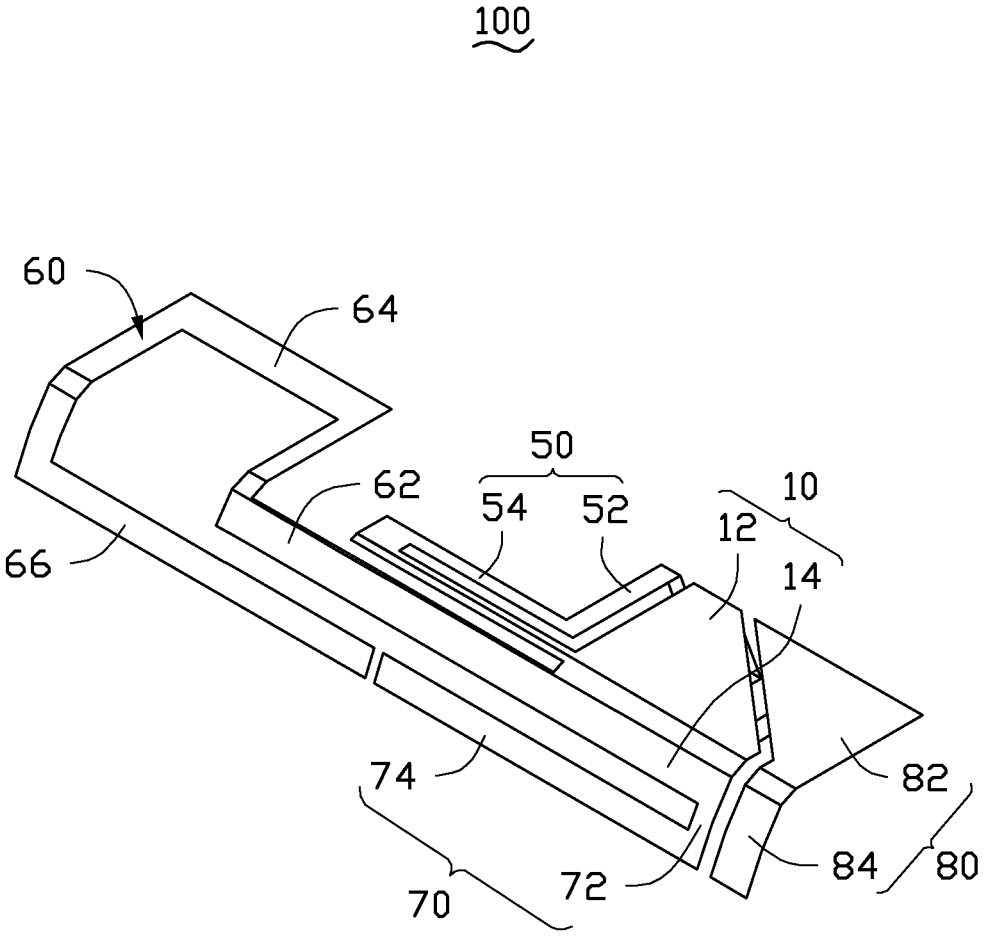
FIG. 4 is an isometric view of the antenna of FIG. 1.

FIG. 4 shows that the main portion 10 includes a flat section 12 and a protruding section 14. The flat section 12 is substantially a right-angled polygons sheet and is arranged substantially parallelly above the circuit board 110. The flat section 12 mainly includes a vertical edge and a bevel edge connecting an up edge and a low edge. The protruding section 14 is formed by protruding from the low edge of the flat section 12 towards the circuit board 110. The protruding section 14 is substantially a rectangular sheet and forms an obtuse angle cooperatively with the flat section 12.

Figure 3:
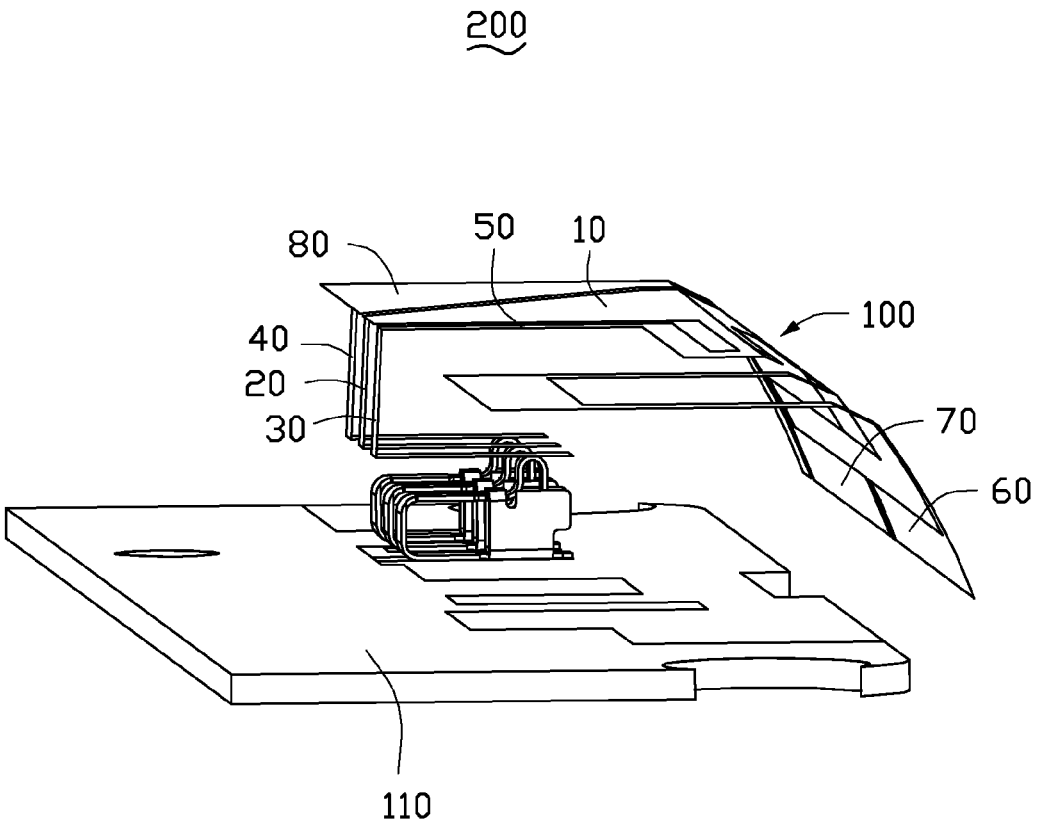
FIG. 3 is a third isometric view of the wireless communication device of FIG. 1.

FIG. 3 shows that the feed portion 20 laterally connects to the up edge of the flat section 12 and is electrically connected to the circuit board 110. The feed portion 20 is used for feeding current signals from the circuit board 110.

The first ground portion 30 and the second ground portion 40 are arranged in parallel on opposite sides of the feed portion 20. The feed portion 20, the first ground portion 30, and the second ground portion 40 are coplanar. The first ground portion 30 and the second ground portion 40 are electrically connected to ground portions of the circuit board 110 for grounding the antenna structure 100.

The connecting portion 50 connects to the first ground portion 30 and is coplanar with the flat section 12. The connecting portion 50 is spaced from and parallel to the vertical edge of the flat section 12. The connecting portion 50 includes a first connecting section 52 and a second connecting section 54. The first connecting section 52 is strip-shaped sheet and connects to the second ground portion 40. The second connecting section 54 is U-shaped sheet, one end of the second connecting section 54 connects to an end of the first connecting section 52 away from the second ground portion 40, the other end perpendicularly connects to the flat section 12.

The first radiating portion 60 includes a first arm 62, a second arm 64, and a third arm 66 connected in order. The first arm 62 perpendicularly connects to the protruding section 14 and is parallel to the second connecting section 54. The first arm 62 is substantially a rectangular sheet and has a longer length than a length of the second connecting section 54. The second arm 64 is substantially a U-shaped sheet and has one end connected to an end of the first arm 62 away from the main portion 10 and another end connected to the third arm 66. The second arm 64 is coplanar with the flat section 12 and the connecting portion 50. The third arm 66 is substantially an L-shaped sheet and has an end connected to the second arm 64 and another end away from the second arm 64 is spaced from and parallel to the first arm 62. The third arm 66 is coplanar with the first arm 62 and the protruding section 14.

The second radiating portion 70 is substantially an L-shaped sheet and includes a fourth arm 72 and a fifth arm 74. The fourth arm 72 perpendicularly connects to an end of the protruding section 14 away from the first arm 62. The fifth arm 74 is spaced from and parallel to the protruding section 14 and the first arm 62. An end of the fifth arm 74 is opposite to an end of the third arm 66. The second radiating portion 70 is coplanar with the protruding section 14, the first arm 62, and the third arm 66.

The coupling portion 80 includes a first coupling section 82 and a second coupling section 84. The first coupling section 82 is substantially an inverted right-angled polygons sheet and is coplanar with the flat section 12. A low edge and an up edge of the first coupling section 82 are collinear with the up edge and the low edge of the flat section 12, respectively. A bevel edge of the first coupling section 82 is adjacent to the bevel edge of the flat section 12. The low edge of the first coupling section 82 connects to the second ground portion 40. The first coupling section 82 is coplanar with the flat section 12, the connecting portion 50, and the second arm 64. The second radiating section 84 is substantially a rectangular sheet and is formed by extending from an end of the first coupling section 82 towards the circuit board 110. The second radiating section 84 is spaced from and parallel to the protruding section 14. The second radiating section 84 is coplanar with the protruding section 14, the second radiating portion 70, the first arm 62, and the third arm 66.

In summary, the antenna structure 100 includes a first plane, a second plane, and a third plane. The flat section 12, the connecting portion 50, the second arm 64, and the first coupling section 82 are positioned on the first plane. The protruding section 14, the first arm 62, the third arm 66, the second radiating portion 70, and the second coupling section 84 are positioned on the second plane. The feed portion 20, the first ground portion 30, and the second ground portion 40 are positioned on the third plane. The second plane has an obtuse angle cooperatively with the first plane. The third plane is perpendicular to the first plane (see FIG. 3).

In the exemplary embodiment, the antenna structure 100 excites a low frequency mode via the feed portion 20, the main portion 10, the first radiating portion 60, the connecting portion 50, and the first ground portion 30; and excites a high frequency mode via the feed portion 20, the main portion 10, the second radiating portion 70, the connecting portion 50, the first ground portion 30, the coupling portion 80, and the second ground portion 40. When the coupling portion 80 is approaching the main portion 10, thereby forming a coupling effect to affect a radiating impedance of the antenna structure 100. Therefore, the signals receiving ability of the antenna structure 100 can be improved by adjusting lengths of the first radiating portion 60 and the second radiating portion 70, and by adjusting a distance and a size between the coupling portion 80 and the main portion 10. When the wireless communication device 200 with the antenna structure 100 is held by a user, such as sending SMS, talking via the wireless communication device 200, or surfing the internet, the antenna structure 100 is close to the user's human body. The user's human body, such as head and hands, may interfere the antenna structure 100 by generating some interference to the antenna structure 100. The interference may be transmitted to the antenna structure 100 and interfere an performance of the antenna structure 100. The coupling portion 80 can effectively transmits the interference to ground to reduce the interference's interfere on the antenna structure 100.

Figure 5:
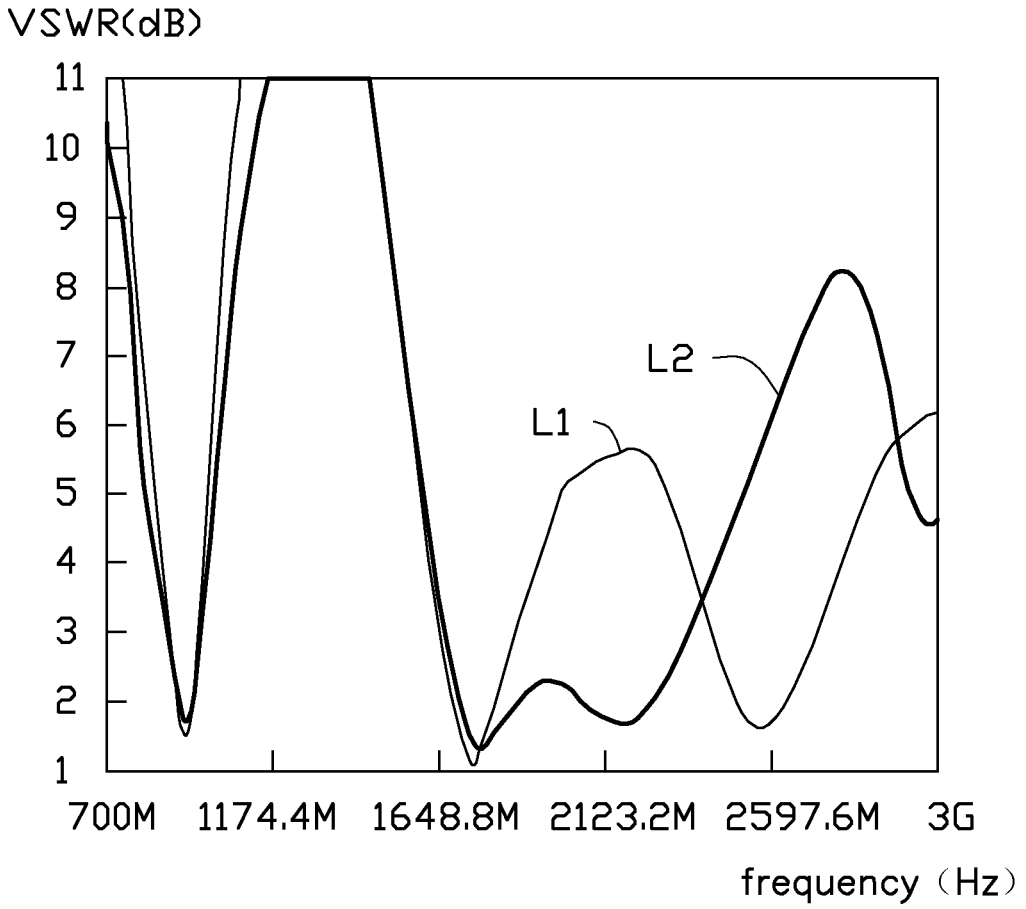
FIG. 5 is a voltage standing wave ratio diagram of the antenna of FIG. 1.

FIG. 5 shows a voltage standing wave ratio (VSWR) diagram of the antenna structure 100. Line L1 shows a voltage standing wave ratio of the antenna structure 100 without the coupling portion 80, and line L2 shows a voltage standing wave ratio of the antenna structure 100 having the coupling portion 80. Line L2 has a lower voltage standing wave ratio during a frequency band of about 1.71 GHz to about 2.17 GHz, that is, the antenna structure 100 has a better impedance coupling by the coupling portion 80, which improve the stability of the antenna structure 100.

Figure 6:
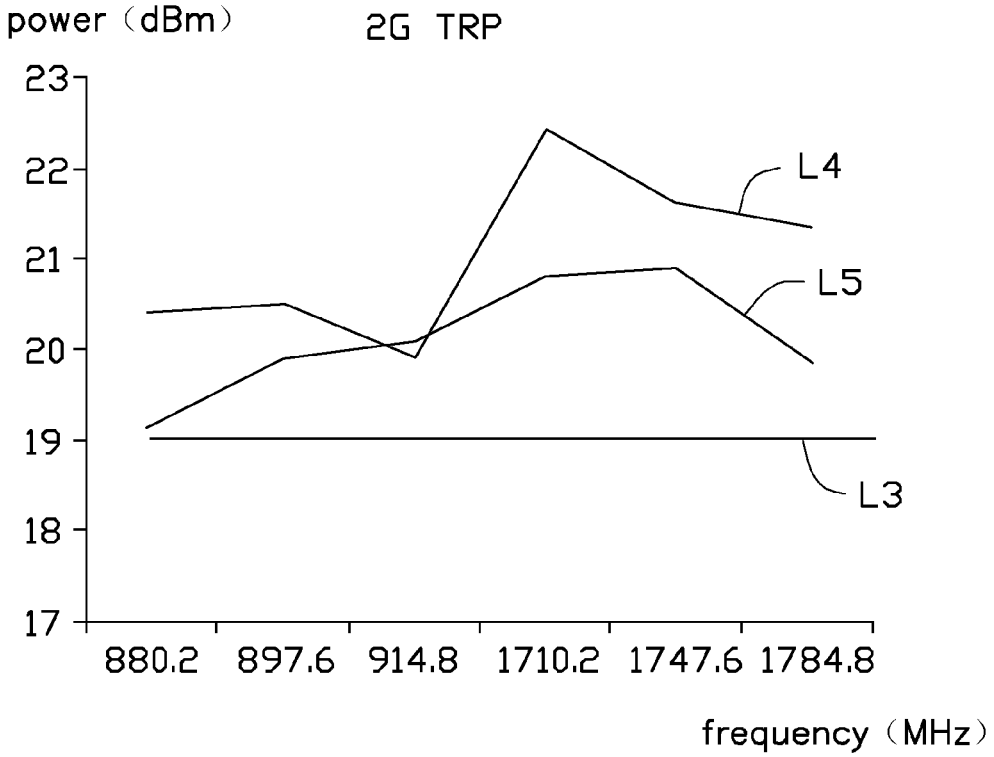
FIG. 6 is a total radiating power diagram of the antenna in a 2G standard.
Figure 7:
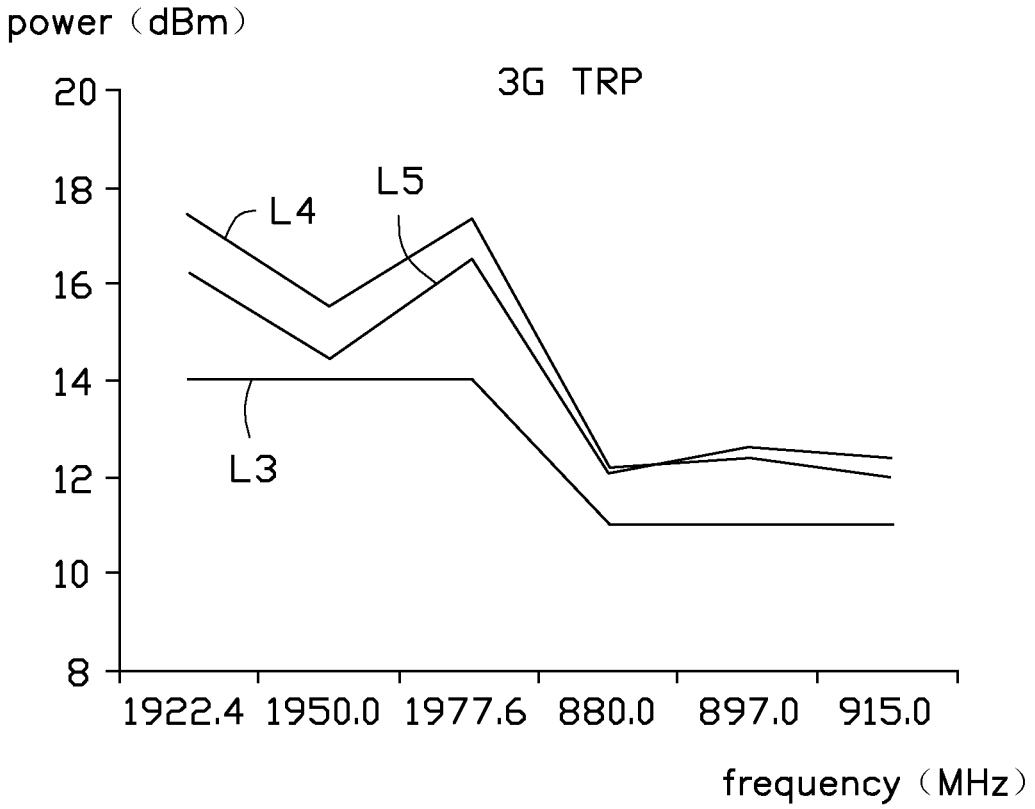
FIG. 7 is a total radiating power diagram of the antenna in a 3G standard.

FIGS. 6 and 7 show a total radiated power (TRP) diagram of the antenna structure 100 in a 2G standard, such as GSM and CDMA, and a 3G standard, such as a WCDMA, respectively. Line L3 shows a traditional TRP standard, line L4 shows a TRP test result when the antenna structure 100 is on the right hand side of the user, and line L5 shows a TRP test result when the antenna structure 100 is on the left hand side of the user. As a result, the antenna structure 100 has a high total radiated power even under interference from the user's human body, thus, the antenna structure 100 has a better ability of transceiving wireless signals.

Figure 8:
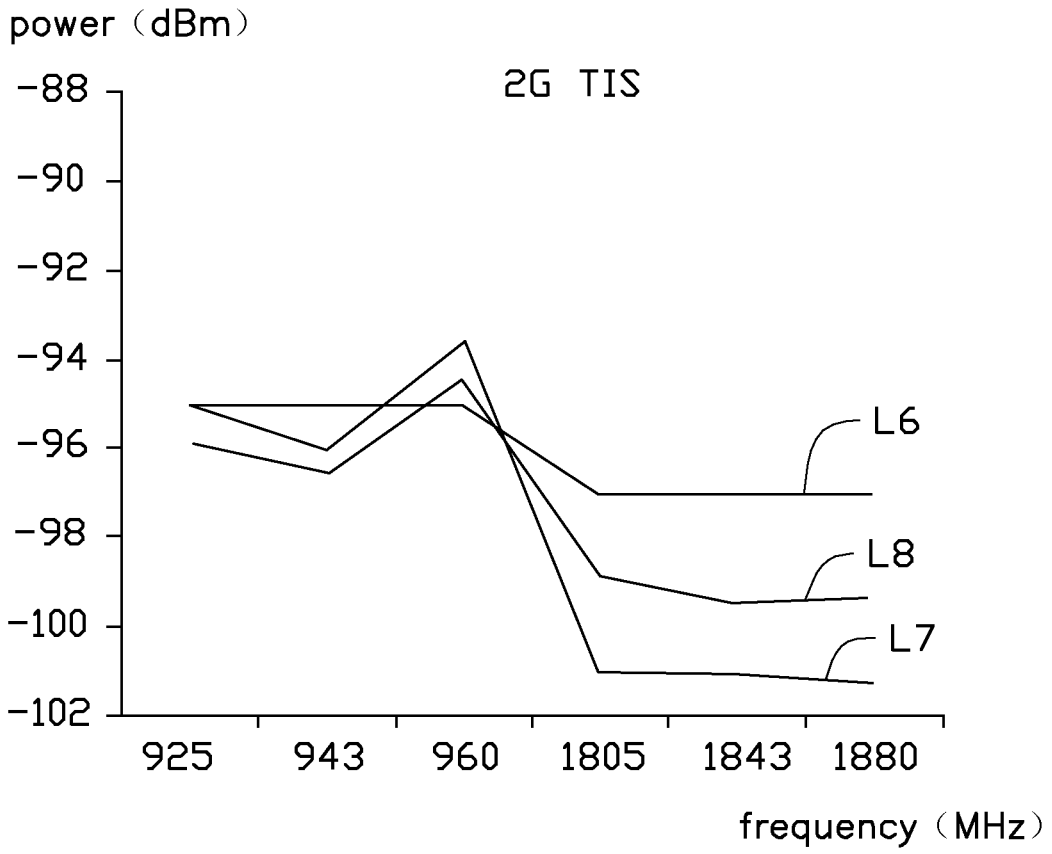
FIG. 8 is a total isotropic sensitivity diagram of the antenna in a 2G standard.
Figure 9:
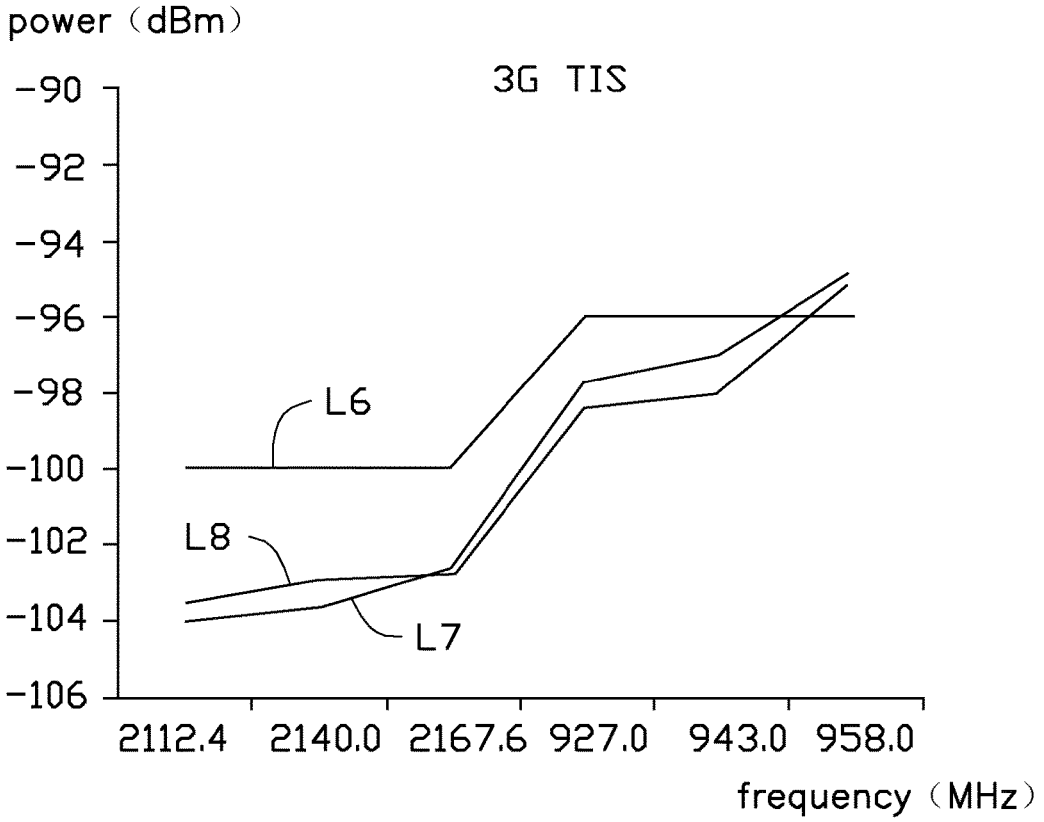
FIG. 9 is a total isotropic sensitivity diagram of the antenna in a 3G standard.

FIGS. 8 and 9 show a total isotropic sensitivity (TIS) diagram of the antenna structure 100 in the 2G standard and the 3G standard, respectively. Line L6 shows a traditional TIS standard, line L7 shows a TIS test result when the antenna structure 100 is on the right hand side of the user, and line L5 shows a TIS test result when the antenna structure 100 is on the left hand side of the user. As a result, the antenna structure 100 has a better ability of transceiving wireless signals.

In other embodiments, the antenna structure 100 can be a solitary band antenna or a multi-band antenna.

In other embodiments, the coupling portion 80 can be arranged adjacent to a side of the main portion 10 connected to the feed portion 20.

The antenna structure 100 includes a coupling portion 80 arranged adjacent to the main portion 10 and the second radiating portion 70 to reduce interference from the user's human body to the antenna structure 100. In addition, the coupling portion 80 can be designed together with the other parts of the antenna structure 100, thus avoiding adding a large extra structure to the antenna structure 100, which can reduce the size and cost of the antenna structure 100.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An antenna structure comprising:

a main portion comprising a flat section, the flat section being substantially a right-angled polygons sheet;

a first radiating portion connected to the main portion;

a second radiating portion connected to the main portion and opposite to the first radiating portion; and a coupling portion spaced from and coplanar with the main portion and opposite to the second radiating portion, the coupling portion comprising a first coupling section being substantially an inverted right-angled polygons sheet and spaced from and coplanar with the flat section, a low edge and an up edge of the first coupling section collinear with an up edge and a low edge of the flat section, respectively, a bevel edge of the first coupling section adjacent to a bevel edge of the flat section;

wherein the main portion and the first radiating portion excite a low frequency mode, the main portion, the first radiating portion, the second radiating portion, and the coupling portion excite a high frequency mode, and when the antenna structure is interfered by an interference generated by a user's human body when close to the user's human body, the coupling portion transmits the interference to ground.

2. The antenna structure as claimed in claim 1, wherein the main portion further comprises a protruding section, the protruding section is formed by protruding from an edge of the flat section, the protruding section forms an obtuse angle cooperatively with the flat section.

3. The antenna structure as claimed in claim 2, further comprising a feed portion, a first ground portion, and a second ground portion, wherein the feed portion laterally connects to an edge of the flat section away from the protruding section, the first ground portion and the second ground portion are parallel arranged on opposite sides of the feed portion, the feed portion, the first ground portion and the second ground portion are coplanar.

4. The antenna structure as claimed in claim 3, wherein the coupling portion further comprises a second coupling section, an edge of the first coupling section connects to the second ground portion, the second coupling section is formed by protruding from an edge of the first coupling section away from the first coupling section, the second coupling section forms an obtuse angle cooperatively with the first coupling section.

5. The antenna structure as claimed in claim 4, wherein the first radiating portion comprise a first arm, a second arm, and a third arm connected in order, the first arm and the third arm are both substantially rectangular sheet and are parallel to each other, the first arm perpendicularly connects to the protruding section, the second arm is substantially a U-shaped sheet connecting the first arm and the third arm on two ends.

6. The antenna structure as claimed in claim 5, wherein the second radiating portion is substantially an L-shaped sheet and comprise a fourth arm and a fifth arm connected in order, the fourth arm is perpendicularly connected to an end of the protruding section away from the first arm, the fifth arm is spaced from and parallel to the protruding section and the first arm, an end of the fifth arm is opposite to the third arm.

7. The antenna structure as claimed in claim 6, further comprising a connecting portion, wherein the connecting portion comprises a first connecting section and a second connecting section, the first connecting section is spaced from and parallel to the main portion and connects to the first ground portion, the second connecting section is substantially a U-shaped and connects the first connecting section and the main portion on opposite ends, the second connecting section is spaced from and parallel to the first arm.

8. The antenna structure as claimed in claim 7, wherein the flat section, the connecting portion, the second arm, and the first coupling section are coplanar and are positioned on a first plane; the protruding section, the first arm, the third arm, the second radiating portion, and the second coupling section are coplanar and are positioned on a second plane; the feed portion, the first ground portion, and the second ground portion are coplanar and are positioned on a third plane.

9. The antenna structure as claimed in claim 8, wherein the second plane has an obtuse angle cooperatively with the first plane, the third plane is perpendicular to the first plane.

10. A wireless communication device, comprising:

a circuit board; and an antenna structure comprising:

a feed portion and a ground portion electrically connected to the circuit board for feeding signals and grounding;

a main portion connected to the feed portion, the main portion comprising a flat section, the flat section being substantially a right-angled polygons sheet;

a first radiating portion connected to the main portion;

a second radiating portion connected to the main portion and opposite to the first radiating portion; and a coupling portion spaced from and coplanar with the main portion and opposite to the second radiating portion, the coupling portion connected to the ground portion, the coupling portion comprising a first coupling section being substantially an inverted right-angled polygons sheet and spaced from and coplanar with the flat section, a low edge and an up edge of the first coupling section collinear with an up edge and a low edge of the flat section, respectively, a bevel edge of the first coupling section adjacent to a bevel edge of the flat section;

wherein the main portion and the first radiating portion excite a low frequency mode, the main portion, the first radiating portion, the second radiating portion, and the coupling portion excite a high frequency mode, and when the antenna structure is interfered by an interference generated by a user's human body when close to the user's human body, the coupling portion transmits the interference to ground.

11. The wireless communication device as claimed in claim 10, wherein the main portion further comprises a protruding section, the protruding section is formed by protruding from an edge of the flat section, the protruding section forms an obtuse angle cooperatively with the flat section.

12. The wireless communication device as claimed in claim 11, wherein the antenna structure comprises a first ground portion and a second ground portion, the feed portion laterally connects to an edge of the flat section away from the protruding section, the first ground portion and the second ground portion are parallel arranged on opposite sides of the feed portion, the feed portion, the first ground portion and the second ground portion are coplanar.

13. The wireless communication device as claimed in claim 12, wherein the coupling portion further comprises a second coupling section, an edge of the first coupling section connects to the second ground portion, the second coupling section is formed by protruding from an edge of the first coupling section away from the first coupling section, the second coupling section forms an obtuse angle cooperatively with the first coupling section.

14. The wireless communication device as claimed in claim 13, wherein the first radiating portion comprise a first arm, a second arm, and a third arm connected in order, the first arm and the third arm are both substantially rectangular sheet and are parallel to each other, the first arm perpendicularly connects to the protruding section, the second arm is substantially a U-shaped sheet connecting the first arm and the third arm on two ends.

15. The wireless communication device as claimed in claim 14, wherein the second radiating portion is substantially an L-shaped sheet and comprise a fourth arm and a fifth arm connected in order, the fourth arm is perpendicularly connected to an end of the protruding section away from the first arm, the fifth arm is spaced from and parallel to the protruding section and the first arm, an end of the fifth arm is opposite to the third arm.

16. The wireless communication device as claimed in claim 15, further comprising a connecting portion, wherein the connecting portion comprises a first connecting section and a second connecting section, the first connecting section is spacingly parallel to the main portion and connects to the first ground portion, the second connecting section is substantially a U-shaped and connects the first connecting section and the main portion on opposite ends, the second connecting section is spaced from and parallel to the first arm.

17. The wireless communication device as claimed in claim 16, wherein the flat section, the connecting portion, the second arm, and the first coupling section are coplanar and are positioned on a first plane; the protruding section, the first arm, the third arm, the second radiating portion, and the second coupling section are coplanar and are positioned on a second plane; the feed portion, the first ground portion, and the second ground portion are coplanar and are positioned on a third plane.

18. The wireless communication device as claimed in claim 17, wherein the second plane has an obtuse angle cooperatively with the first plane, the third plane is perpendicular to the first plane.

* * * * *